United States Patent [19]

Sakulevich et al.

[11] 4,306,386

[45] Dec. 22, 1981

[54] METHOD OF FINISHING FERROMAGNETIC ARTICLES BY FERROMAGNETIC ABRASIVE POWDERS IN MAGNETIC FIELD

[76] Inventors: Faddei J. Sakulevich, pereulok Dalny, 3; Ella N. Kudinova, Leninsky prospekt, 151, kv. 315, both of Minsk, U.S.S.R.

[21] Appl. No.: 98,409

[22] Filed: Nov. 29, 1979

Related U.S. Application Data

[63] Continuation-in-part of Ser. No. 911,146, May 31, 1978, abandoned.

[51] Int. Cl.[3] ..... B24C 1/00

[52] U.S. Cl. ..... 51/317; 51/7

[58] Field of Search ..... 51/7, 16, 17, 161, 317, 51/430

[56] References Cited

U.S. PATENT DOCUMENTS 4,169,713 10/1979 Chachin ..... 51/7
4,175,930 11/1979 Sakulevich ..... 51/317

FOREIGN PATENT DOCUMENTS 2823707 2/1979 Fed. Rep. of Germany ..... 51/317
112092 3/1975 German Democratic Rep. ..... 51/7
1370356 10/1974 United Kingdom ..... 51/317
165651 10/1964 U.S.S.R. ..... 51/317
564140 7/1977 U.S.S.R. ..... 51/7
595142 2/1978 U.S.S.R. ..... 51/317

OTHER PUBLICATIONS

"Fundamentals of Electromagnetic Treatment," E. G. Konovalov et al., pp. 145–151 and 204 to 208.

*Primary Examiner*—Gary L. Smith
*Attorney, Agent, or Firm*—Fleit & Jacobson

[57] ABSTRACT

A method of finishing of ferromagnetic articles by means of ferromagnetic abrasive powders in a magnetic field formed by electromagnets of opposite polarities, wherein a ferromagnetic abrasive powder and a ferromagnetic article are first magnetized to the saturation induction, then the ferromagnetic article is placed into an external magnetic field so as to form a working gap between said ferromagnetic article and the poles of electromagnets, the total magnetic field produced therein being the sum of the external magnetic field and the field of said magnetized ferromagnetic articles. The ferromagnetic powder is finally introduced into the working gap to form a cutting "brush" and the article and the external magnetic field are brought into relative motion.

2 Claims, 5 Drawing Figures

METHOD OF FINISHING FERROMAGNETIC ARTICLES BY FERROMAGNETIC ABRASIVE POWDERS IN MAGNETIC FIELD

This is a continuation-in-part of application Ser. No. 911,146, filed on May 31, 1978, now abandoned.

This invention relates to abrasive treatment of articles in a magnetic field and, more particularly, to a method of finishing ferromagnetic articles by means of ferromagnetic abrasive powders in a magnetic field.

1. Field of the Invention

This invention can be used most advantageously for finishing large size workpieces where powerful magnetic systems and displacement of large masses are required.

The known methods for finish treatment of articles of large size and mass, including grinding by graphite disks, superfinishing, honing, machine polishing with abrasive tapes or abrasive pastes, are all highly labour consuming, tend to create antisanitary labour conditions and avail no possibility for controlling the technological and output parameters of the process. In contrast, the proposed process of magnetic abrasive polishing can be readily automatized, can help reduce the cost of manufacturing large size articles, improve their quality and at the same time create better labour conditions.

2. Prior Art

Known in the art is a method of surface finishing by means of ferromagnetic powder in a magnetic field where a ferromagnetic article to be treated is placed into an external magnetic field produced by electromagnets of opposite polarities so as to form a working gap between said article and the poles of said electromagnets, the total magnetic field produced in said gap being equal to the external magnetic field and the field of said article magnetized by the external field. A ferromagnetic abrasive powder is then introduced into the working gap to form a magnetic abrasive cutting "brush" and the article and the powder are brought into a relative motion. For instance, the article may be rotated whereas the poles of the electromagnets are oscillated (cf., Konovalov E. G. et al., Principles of Electromagnetic Processing, Minsk, 1974, pp. 145–151, 205–208. /in Russian/).

This known method, however, is deficient in that the poles of the magnetic system are worn out with the oscillation in the course of treatment since the magnetic abrasive powder is equally drawn to the poles and the magnetized article and the one which is more magnetized and moves in relation to the powder is abrased.

There is also known a method for finishing ferromagnetic articles by ferromagnetic abrasive powders in a magnetic field (cf., the USSR Inventor's Certificate No. 165,651, Cl. 67a 3/30) where a ferromagnetic article to be treated is placed into an external magnetic field formed by electromagnets of opposite polarities so that a working gap is formed between the article and the poles of the electromagnets, the total magnetic field produced in said gap being equal to the external magnetic field and the field of the article magnetized by the external field, a ferromagnetic powder is then introduced into the working gap to form a magnetic abrasive cutting "brush" and the ferromagnetic article and the external field are brought into a relative motion.

The known method is highly energy consuming since an appreciable magnetic field induction of 0.8–1.2 T is to be maintained in the gap between the article and poles throughout the process of treatment in order to hold powder particles along the force lines. The upper limit is however restricted by the saturation induction attainable in the poles of the electromagnets. On the other hand, such magnetic field induction cannot magnetize the article to saturation, thus limiting the efficiency of the method. Another deficiency consists in serious wear of the poles since the magnetic abrasive powder is equally drawn to the article and the poles and the one which moves in relation to the powder tends to be treated. This is due to the fact that the magnetic field in the working gap is the sum of the external field (the field of the electromagnets) and the field of the article magnetized by said field, whereas the force attracting a powder grain in the working gap is in cubic relation to the magnetic field strength and is directed towards the field intensification. Thus, a powder grain which is in direct contact with the magnetized surface (a pole of electromagnets or the magnetized article) is drawn to the latter. The force of attraction of the powder to the poles can even be greater than that directed to the article being treated if the magnetization of the poles is greater than that of the article, which is not a rare occurrance since the poles of the electromagnets are often made of steel of high magnetic permeability.

OBJECTS OF THE INVENTION

It is the main object of the invention to reduce the consumption of energy.

Another object of the invention is to increase the efficiency of the process.

One more object of the invention is to prevent the wear of the electromagnet poles.

Still another object of the invention is to reduce the magnetic induction of the external magnetic field.

These and other objects of the invention are achieved in the following method of finishing ferromagnetic articles by ferromagnetic abrasive powders in a magnetic field. A ferromagnetic article to be treated is placed into an external magnetic field formed by electromagnets of opposite polarities so as to form a working gap between said article and the poles of said electromagnets, the total magnetic field therein being the sum of the external magnetic field and the field of the article magnetized by this external field. A ferromagnetic abrasive powder is then introduced into the working gap to form a magnetic abrasive cutting "brush" and the ferromagnetic article and the external field are brought into a relative motion. According to the invention, the ferromagnetic powder, before it is introduced into the working gap, and the ferromagnetic article, before it is placed into the external magnetic field, are both magnetized to saturation induction.

The maximum possible force with which the ferromagnetic abrasive powder is drawn to the article being treated can be attained in this way. This is due to the fact that the magnetic field strength in the working gap is conditioned by the external field (the field of the electromagnets) and the field of the article magnetized by this field, and the force attracting a powder grain in the working gap is in cubic relationship to the magnetic field strength and is directed towards the field intensification, which is in this case the body of the article or workpiece) since it is magnetized to the maximum—i.e. the saturation induction. The external magnetic field in the working gap should be maintained within a range of 0.06–0.08 T (webers/meter$^2$).

Such a field strength produces no saturation induction in the poles of the electromagnets and, consequently, contributes to weakening of attraction of the powder to the poles. This eliminates the wear of the poles by the moving powder and, besides, helps to save energy.

When magnetic induction in the working gap grows over 0.08 T, the economic efficiency of the proposed method deteriorates. When magnetic induction drops below 0.06 T, the force of attraction of the powder to the article may weaken and impair the productivity of the process in this manner.

The invention will now be described in greater detail with reference to a specific embodiment thereof, accompanied by drawings, wherein.

Figure 1:
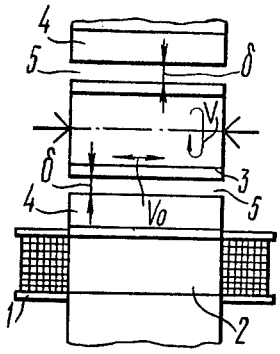
FIG. 1 illustrates a plan view of a layout for finishing a shaft made of a ferromagnetic material by means of a ferromagnetic abrasive powder (not shown) using pole shoes whose length is equal to the length of the shaft.

The proposed method of finishing ferromagnetic articles by means of ferromagnetic abrasive powders in a magnetic field consists in the following. An article 3, a sleeve in this case, is placed in an external magnetic field produced by coils 1 (FIG. 1) featuring cores 2 of different polarities so that the coils 1 with the cores 2 are arranged radially and opposite one another on both sides of the article 3 and connected to a rectifier (not shown). The cores 2 are provided with poles 4 whose size and shape correspond to the size and shape of the article 3. Permanent working gaps 5 are set between the poles 4 and the article 3. Magnetic force lines 6 (FIG. 2) stretch through the article 3. A ferromagnetic abrasive powder 7 (FIG. 3) is placed in the working gaps 5 wherein the total magnetic field is the sum of the external magnetic field and the field of the article magnetized by this external field. Grains 8 (FIG. 4) of the powder 7 are positioned in accordance with the magnetic force lines 6. Afterwards the ferromagnetic article 3 and the external field are set in a relative motion. The ferromagnetic abrasive powder 7 and the ferromagnetic article 3 are magnetized to the saturation induction before treatment, that is before being placed into the external magnetic field. The external magnetic field in the working gap 5 is kept at 0.06–0.08 T throughout the process.

In cases when the ferromagnetic abrasive powder posesses low magnetic permeability, it is the ferromagnetic article only that is being magnetized to the saturation induction prior to treatment and before being placed into the external magnetic field.

Figure 2:
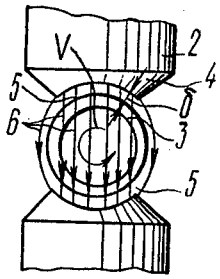
FIG. 2 illustrates a side view of FIG. 1.
Figure 3:
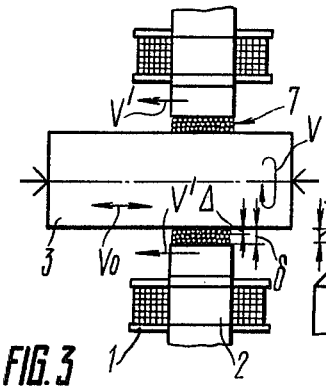
FIG. 3 illustrates an arrangement of powder grains of a ferromagnetic abrasive powder between the pole shoes and the shaft being processed.
Figure 4:
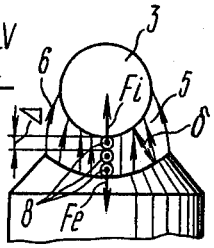
FIG. 4 illustrates a diagram of forces of a magnetic origin, attracting the grains of the ferromagnetic powder in the gap between a pole shoe and the shaft.
Figure 5:
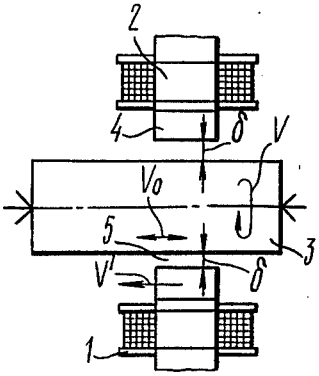
FIG. 5 illustrates a layout of finishing a shaft made of a ferromagnetic material by means of a ferromagnetic abrasive powder (not shown) using pole shoes whose length is less than that of the shaft.

In order to magnetize the ferromagnetic abrasive powder 7 and the ferromagnetic article 3 to the saturation induction the coils 1 with the cores 2 should produce a magnetizing field with the intensity of magnetization of $50 \cdot 10^3$ Amp/m. The length of the pulse depends solely upon the size of the article 3. The working gaps 5 between the pole shoes 4 and the article 3 are set uniform throughout the length of the article 3. The width and shape of the working gaps 5 also depend upon the size and shape of the article 3 and upon length to which the pole shoes 4 can be pushed forward (FIGS. 1 and 5). The width $\delta$ (FIG. 3) of the working gap 5 is set so that three or four whole grains 8 of the abrasive ferromagnetic powder 7 can fit in. The cutting as such is done by one grain 8 whichever is in contact with the article 3, whereas other grains 8 on which it rests hold the cutting grain in the gap 5 (FIG. 3). The number of grains 8 is calculated on the basis of their diameter $\Delta$ (FIG. 4) and the dimensions of the gap 5 so that the gaps are filled completely and uniformly as in FIG. 3. Powder grains of different diameters are used depending on the grade of finish which is to be obtained. The width $\delta$ of the gap 5, therefore, is set in accordance with such a grade of finish and the diameter $\Delta$ of the grains 8 of the powder 7. The grains 8 of the ferromagnetic abrasive powder 7 positioned along the magnetic force lines 6 remove metal from the surface of the ferromagnetic article 3 which rotates at a speed V ranging from 1.3 m/s to 2.1 m/s. Such a speed helps overcome the force of friction between the article 3 and the ferromagnetic grains 8 drawn thereto. The pole shoes 4 are set in oscillation at a speed of $V_o$ ranging from 0.5 m/s to 0.1 m/s, which helps mix the grains 8 in the working gaps 5. When the length of the pole shoes 4 is less than the length of the article 3, they are set into a forward motion at a speed of $V^1$ ranging from 0.05 m/s to 0.003 m/s. A field whose magnetic induction is equal to the magnetization of the article, which corresponds to the saturation induction of the material of the article, acts on the grains 8 of the ferromagnetic powder 7 composed, for instance, of 80% Fe+20% TiC, which is filled into the gaps 5 by means of a batching hopper, said grains 8 being in contact with the article 3. The powder grains are drawn to the surface of the magnetized article with a force Fi (FIG. 4) proportional to the saturation induction and to the poles with a force Fe proportional to the external field of 0.06–0.08 T. Removal of metal from the surface of the article is, consequently, intensified, which results in higher efficiency of the method, whereas the poles are practically not weared out at all. As the article rotates with a speed required to overcome the friction between the article and the grains of the ferromagnetic abrasive powder drawn thereto, metal is removed from the surface of the article. The permanent external magnetic field of 0.06–0.08 T which produces current in the coils 1 with cores 2 holds the grains 8 of the ferromagnetic abrasive powder 7 in the working gap 5.

Thus, for a 200 mm long shaft with a diameter of 75 mm made of chromium steel for roller and ball bearings with the following composition: C (carbon) 0.95%–1.10%, Si (silicon) 0.15–0.35%, Mn (manganese) 0.20–0.4%, S (sulphur) 0.02%, P (phosphorus) 0.027%, Cr (chromium) less than 1.30–1.65%, Ni (nickel) not more than 0.2%, with a hardness of 58–61 HRc, an absolute magnetic permeability of $4.08 \cdot 10^{-5}$ H/m the saturation induction is equal to 2.04 T and the magnetizing field amounts to $50 \cdot 10^3$ a/m. An external magnetic field with a magnetic inductance of 0.06–0.08 T is maintained throughout the process in the gap 5 between the article 3 and the pole shoes 4. This external field keeps the article and the grains from loosing their magnetization which draws ferromagnetic grains in the working gap and weakens the attraction of ferromagnetic grains to the poles as compared to their attraction to the article.

Here are some concrete examples.

EXAMPLE 1

A sleeve made of a ferromagnetic material, for instance, of carbon steel with a normal content of manganese and with a following chemical composition: C (carbon) 0.4–0.5%, Mn (manganese) 0.45–0.7%, Si (silicon) 0.15–0.30%, S (sulphur) 0.055%, P (phosphorus) 0.045%, Cr (chromium) not more than 0.3%, Ni (nickel) not more than 0.3%, with a hardness of 28–30 HRc, diameter of 30 mm and 50 mm long, which is to be polished to grade 12 (that is, polished in such a manner as to provide a finished surface having unevenness from 0.04 to 0.02 mm, high), is first fit onto a mandrel made of a ferromagnetic material. The sleeve fit on the mandrel is put on the machine for finishing articles by ferromagnetic abrasive powders in a magnetic field and secured by a grip at one end and tightened by the pin so that the coils with the cores are arranged radially from both sides of the grip. The coils with the cores, featuring poles whose length is equal to the length of the sleeve, are connected to a rectifier. Permanent working gaps are set between the pole shoes and the workpiece, their width adjustable from 0 to 0.4 mm. A permanent gap is set whose width is 0.4 mm. Then the coils of electromagnets are energized with a 5 A current which produces a magnetizing field of $50 \cdot 10^3$ A/m. The abrasive ferromagnetic powder composed of 80% Fe and 20% TiC whose grain diameter is equal to 0.1 mm is filled from the batching hopper into the gaps so that 10 g of powder is uniformly distributed therein. The length of the magnetizing pulse is 15 sec and depends on the dimensions of the workpiece and gaps, as well as on the magnetic properties of the ferromagnetic abrasive powder and the sleeve. The current in the coils is then reduced to 1 A. Such current intensity produces an external field of 0.08 T in the working gaps. The magnetized grains of the ferromagnetic abrasive powder are drawn to the magnetized workpiece under the influence of magnetic forces and position themselves in the magnetic field along the magnetic force lines. The grains which are in contact with the surface of the sleeve are drawn thereto with a force proportional to the magnetization of the sleeve, taking into account the magnetic properties of the powder grains and the sleeve. The sleeve is then set into rotation at a speed of $V=2$ m/sec which helps overcome the friction between the powder grains and the sleeve. The poles are set into oscillation along an axis at a speed of $V_o=0.3$ m/sec which helps mix the powder grains in the working gaps. The powder grains are in this case held in these gaps by a permanent magnetic field of 0.08 T and do the removal of metal from the surface of the sleeve.

The process of treatment takes 30 seconds.

EXAMPLE 2

The proposed method is carried out as follows.

A shaft is made of a ferromagnetic material, for instance, steel of the following composition: C (carbon) 0.95–1.10%, Si (silicon) 0.15–0.35%, Mn (manganese) 0.20–0.4%, S (sulphur) 0.02%, P (phosphorus) 0.027%, Cr (chromium not more than 1.30–1.65%, Ni (nickel) not more than 0.2%. The hardness of steel is 67–80 HRc. The shaft is 200 mm long and 75 mm in diameter and is to be polished to the 10th grade of finish (that is, polished in such a manner as to provide a finished surface having unevenness from 0.08 to 0.04 mm. high). Such a shaft is placed in a machine for finishing articles by means of ferromagnetic abrasive powders in a magnetic field and rigidly secured by a grip from one end and tightened by the pin so that the cored coils are arranged radially on both sides of the shaft. The coils with cores are connected to a rectifier and provided with poles whose length is less than the length of the shaft. Permanent working gaps between the poles and the shaft can be adjusted for width from 0 to 0.8 mm. A permanent 0.8 mm wide gap is set between the poles and the shaft. The coils of electromagnets are energized with a current of 7 A which produces the required magnetizing field of $56 \cdot 10^3$ A/m. Then 30 grams of an abrasive ferromagnetic powder composed of 80% Fe and 20% TiC whose grains are 0.2 mm in diameter are filled from a batching hopper into the gaps so that they are uniformly distributed therein. The magnetizing pulse is 30 sec long and depends on the dimensions of the shaft and the gaps, as well as the magnetic properties of the ferromagnetic abrasive powder and the shaft. The current is then reduced to 0.5 A to produce an external field of 0.06 T in the working gaps. The magnetized grains of the ferromagnetic abrasive powder are drawn to the magnetized shaft under the influence of the magnetic forces and position themselves in the magnetic field along the magnetic force lines. The grains which are in contact with the surface of the shaft are drawn thereto with a force proportional to the magnetization of the shaft, taking into account the magnetic properties of the powder grains and the shaft. The shaft is set into fast rotation with a speed of 1.6 m/sec which is required to overcome the force of friction between the powder grains and the shaft. The poles are set into oscillating motion along an axis with a speed of 0.2 m/sec which helps mix the powder grains in the working gaps and into forward motion along the axis at a speed of 0.005 m/sec which helps obtain uniform finish throughout the shaft length. The powder grains are held in the gaps by the permanent magnetic field of 0.06 T and remove metal from the surface of the shaft.

The process of finishing takes 60 seconds.

What is claimed is:

1. A method for finishing ferromagnetic articles by ferromagnetic abrasive powders in a magnetic field, wherein an external magnetic field is formed by electromagnets of different polarities, comprising the steps of:

magnetizing said ferromagnetic abrasive powder and said ferromagnetic article to saturation induction;

placing said magnetized ferromagnetic article in said external magnetic field so that a gap is formed between the poles of the electromagnets and said magnetized ferromagnetic article, wherein a total magnetic field is created, said total magnetic field being the sum of the external magnetic field and the field of said magnetized article;

introducing said magnetized ferromagnetic abrasive powder into the gap formed by the poles of the electromagnets and said magnetized ferromagnetic article; and imparting a relative motion to said magnetized ferromagnetic article and the external magnetic field formed by said electromagnets of different polarities.

2. A method of finishing ferromagnetic articles as claimed in claim 1, wherein said total magnetic field in said gap is kept within the range of 0.06 T to 0.08 T.

* * * * *